United States Patent [19]

Trojahn et al.

[11] 3,935,688

[45] Feb. 3, 1976

[54] IMPERVIOUS WALL STRUCTURE

[75] Inventors: Charles Joseph Trojahn, Middle Village; Nikolaus Friedrich, Maspeth, both of N.Y.

[73] Assignees: Charles J. Trojahn, Middle Village; Friedrich Metal Products Co., Woodside; Frank Brunckhorst Co., Brooklyn, all of N.Y.

[22] Filed: Dec. 3, 1973

[21] Appl. No.: 420,775

[52] U.S. Cl. ..... 52/622; 52/488; 105/401; 52/745; 228/203; 228/101; 228/216

[51] Int. Cl.[2]..... E04C 2/00; E04B 1/00; B23K 1/20

[58] Field of Search ..... 29/488, 470, 491, 488; 52/573, 588, 404, 618–622, 493, 615, 578, 63, 315, 580, 745; 105/401, 409, 422

[56] References Cited

UNITED STATES PATENTS

| | | | |
|---|---|---|---|
| 1,582,611 | 4/1926 | Kane | 52/588 |
| 2,117,397 | 5/1938 | Bonsall | 52/622 |
| 2,268,188 | 12/1941 | Clarke | 105/401 |
| 2,705,549 | 4/1955 | West | 105/422 |
| 2,739,677 | 3/1956 | Greulich | 52/622 |
| 2,758,870 | 8/1956 | Nallinger | 105/401 |
| 2,896,271 | 7/1959 | Kloote et al. | 52/63 |
| 3,296,766 | 1/1967 | Dean | 105/409 |
| 3,347,010 | 10/1967 | Richter | 52/588 |
| 3,363,391 | 1/1968 | Bordenave | 52/578 |
| 3,793,789 | 2/1974 | Greenamyer | 52/615 |

FOREIGN PATENTS OR APPLICATIONS

| | | | |
|---|---|---|---|
| 98,732 | 7/1965 | United Kingdom | 52/573 |
| 6,515,324 | 5/1966 | Netherlands | 52/573 |

*Primary Examiner*—James L. Ridgill, Jr.
*Attorney, Agent, or Firm*—Kane, Dalsimer, Kane, Sullivan and Kurucz

[57] ABSTRACT

An impervious wall structure including at least two panels welded along adjoining vertical edges. Stress relief structure is on the panels to facilitate welding of the panels without undesirable deformation thereof. Finally, support structure is provided to assist in reinforcing the panels thereby providing a continuous impervious wall structure adaptable for use over large areas.

6 Claims, 2 Drawing Figures

IMPERVIOUS WALL STRUCTURE

BACKGROUND OF THE INVENTION

In certain storage areas, it is important that the wall surfaces be as clean as possible. This is particularly true in meat storage rooms, pharmaceutical storage rooms and other similar areas such as an operating room. Minimizing the chances for bacteria contamination is important. In this regard, walls which are smooth and impervious are easy to maintain from a cleanliness standpoint.

Wall surfaces that are roughened or contain apertures formed by cracks or seams are difficult to maintain in a bacteria-free environment. Contamination tends to accumulate in the roughened surfaces and cracks where access is difficult.

This problem is quite apparent in large cold storage rooms such as meat lockers. In general, in the past the walls have been constructed of a ceramic tile material with grouting between the ceramic blocks. Grime and contamination tends to accumulate in the grouted surface which is roughened in nature in contrast to the glazed ceramic surface and therefore there is no easy or sure way to clean the grouted seams between the blocks. This is also true in regards to the corners formed at the floor and ceiling in such a room.

Other types of wall surfaces which have been employed generally utilize some sort of paneling in which the panels are joined at the seams. The panels may be of a metallic material or similar rigid surface material. Once again, the seams generally form an aperture or space for accumulation of contaminating substances. Access to the seams is difficult and cleaning is difficult.

Attempts to produce seamless impervious walls have been fruitless to date. Attempts at welding metal panels to form a wall surface have encountered dfficulties when the panels are welded due to internal stresses in the metal which cause the panels to buckle and deform thereby forming an unsatisfactory wall surface. The tendency of materials to deform under external stimulus such as welding and other effects on temperature and pressure have made it extremely difficult if not impossible to produce a smooth impervious wall surface.

It would certainly be an improvement in construction of rooms such as meat storage rooms, operating rooms or pharmaceutical storage rooms to provide wall surfaces of a smooth impervious nature to facilitate maintenance and alleviate the danger of contamination.

Summary of the Invention

With the above background in mind, it is among the primary objectives of the present invention to provide an impervious wall structure which can be utilized to form a wall surface and alleviate the danger of contamination collection on roughened surfaces or apertures. The system is designed for ease of insulation and for minimal maintenance in the cleaning process.

In summary, the impervious wall structure of the present invention includes at least two panels welded along adjoining vertical edges. Stress relief means are on the panels to facilitate welding of the panels without undesirable deformation of the panels. Finally, support means is present to assist in reinforcing the panels and thereby providing a continuous impervious wall structure adaptable for use over large areas.

The configuration of the panels along their edges is such that female and male interengaging surfaces are present to facilitate welding and assembly to form the impervious continuous structure. Appropriate insulation means can be provided to make the wall structures useful in cold storage or hot storage areas. The configuration of the exposed wall surface is designed so that internal stresses in the wall surface are relieved during the welding process to eliminate buckling and deformation of the structure. It should also be kept in mind that the structure of the present invention is adaptable for interior use in a room or exterior use for a building or any other location where a smooth impervious wall surface is desired. The method of construction and assembly is facilitated by the built-in structural design criteria of the individual panels so that the panels are readily adaptable for installation with respect to existing building criteria.

With the above objectives, among others, in mind, reference is had to the attached drawing.

DESCRIPTION OF THE PREFERRED EMBODIMENT

Figure 1:
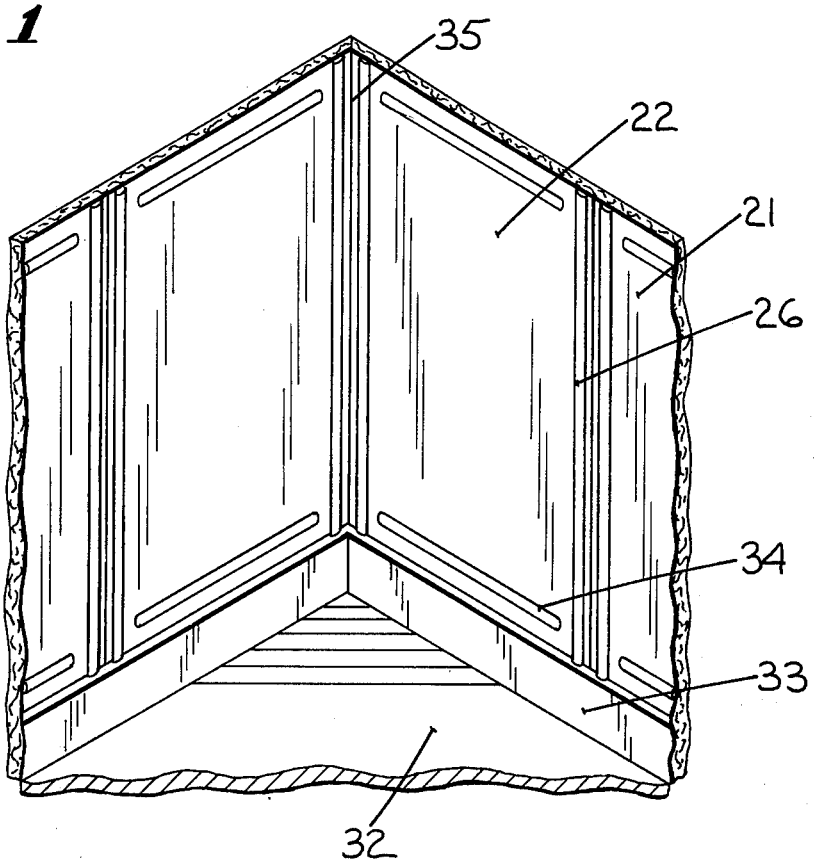
FIG. 1 is a fragmentary perspective view of an interior wall assembly of the impervious wall structure of the present invention.

Impervious wall structure 20 includes at least a pair of adjacent adjoining panels such as panels 21 and 22. The panels depicted are designed for specific suitability in an insulation environment such as for cold or hot storage. For example, a meat storage room would utilize panels of the type depicted.

Each of the panels includes an outer surface layer 23, an intermediate layer 24 and a backing layer 25. As shown, the surface layer is stainless steel. Naturally, well known equivalents of stainless steel as a smooth impervious surface material would be equally acceptable. However, for purposes of the embodiment depicted, stainless steel is utilized for surface layer 23. Intermediate layer 24 is generally of an insulation material such as styrofoam, urethane or any other well known substitute therefor.

Backing layer 25 is designed to be a rigid reinforcing flat surface and it has been found that flat reinforced fiberglas is adequate for this purpose. Naturally, other acceptable substitutes such as wood, aluminum, steel, and stainless steel can be utilized for backing layer 25.

Surface layer 23 is affixed to intermediate layer 24 and intermediate layer 24 is affixed to backing layer 25 in any convenient well known manner such as by utilization of a suitable epoxy or adhesive or other bonding agent.

Adjacent each of the pair of opposing vertical edges of stainless steel surface layer 23 is a longitudinal bead 26. Bead 26 is designed to be adjacent to the point of welding between a pair of panels 21 and 22 so as to assist in relieving stresses contained within the panel when welding occurs and preventing buckling of the panels. It has been found that very large surface areas having a stainless steel outer surface can be welded in this manner without danger of buckling. In fact, no noticeable deformation of the panels occurs. It has been found that lengths as large as 8 feet of welded seam have been successfully accomplished without danger of bowing or other deformation in the panels.

Figure 2:
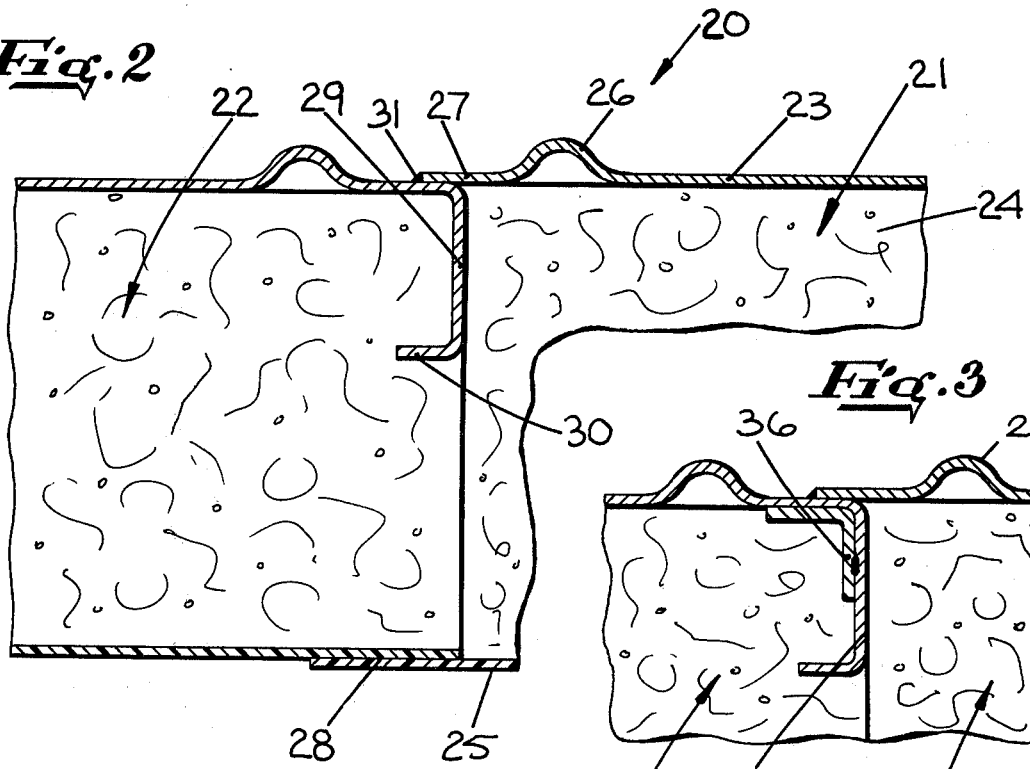
FIG. 2 is a fragmentary sectional view thereof.

Each panel has one vertical edge which is designed to function as a female receptacle and the opposing vertical edge is designed to function as a male member. As shown in FIG. 2, the female vertical edge of panel 21 is mated with the male vertical edge of panel 22. To provide the receptacle surfaces, a vertical tab 27 of outer layer extends from the flush position with respect to intermediate layer 24 and similarly, a tab 28 extends from back layer 25 from the flush position with respect to the edge of intermediate layer 24. Consequently, vertical tabs 27 and 28 form a receptacle for the seating of the edge portion of panel 22.

On the male side of each panel, stainless steel surface layer 23 is designed to extend around the corner of the edge of panel 22 and along the edge surface of intermediate layer 24 a predetermined distance to form lateral projection 29. At the terminal end of lateral projection 29 is an inwardly extending lip 30 which is seated within intermediate layer 24. Projection 29 and lip 30 are affixed to intermediate layer 24 in the same manner as the remainder of surface layer 23. The provision of projection 29 and lip 30 provides additionalal reinforcement adjacent the point of welding. The actual welding between panels 21 and 22 occurs between the interengaging surfaces of the adjacent surface layers 23 along vertical welding line 31. The result is a smooth stainless steel impervious wall surface for use in a room as depicted in FIG. 1.

The overlapping portions of back layer 25 caused by the extension 28 from the male edge of panel 21 can be interengaged with one another in any conventional fashion such as by frictional interengagement. The presence of intermediate layer 24 and back layer 25 assist in supporting the surface panels 23 and the overall panel structures during and subsequent to welding. This additional support aids in preventing deformation and buckling of stainless steel surface layer 23 and additionally cooperates with beads 26 to maintain the overall smooth undeformed stress relieved impervious exterior surface on the ultimate wall structure 20.

Panels 21 and 22 are shown in assembled position for forming a portion of a wall within a room. In assembling the panels to the remainder of the room structure, the panels are welded along their base edge to a curb panel 33 which extends around the base of the room 32. Beads 34 in a horizontal direction on each panel correspond to vertical beads 26 in that they provide for relief of stress within the stainless steel panel during the actual welding process. Curb portions 35 may be of the same material as surface layer 33 of the panels.

At the corners of the room, an arcuate vertical corner plate 35 is provided and is designed to seat in the corner of the room and to be welded to the two adjacent panels extending on adjacent walls. Appropriate beads are provided for the welding operation and corner piece 35 may be of the same material as curb 33 and the panels so as to continue the smooth impervious continuous wall structure in the room.

Although it is not shown, if desired, the wall panels can be welded to an appropriate ceiling panel when it is felt that such installation is appropriate. Similarly, the floor 32 could be provided with a panel for welding to the wall structure. All of the welding to the ceiling and floor would be conducted in a similar manner to the welding process described above.

Figure 3:
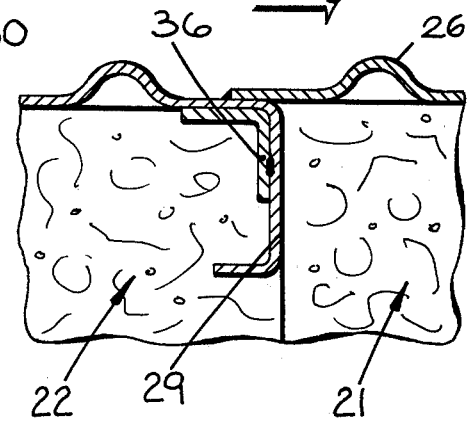
FIG. 3 is a fragmentary sectional view of an alternate embodiment thereof.

An alternate form of panel is shown in FIG. 3 where a vertical chill strip 36 is mounted on the intermediate layer 24 adjacent to the area of welding strip 31 and in communication with an adjacent panel surface layer. Chill strip 36 is of a right angle configuration and extends the vertical height of the panel in alignment with the welding line. A common rigid supporting material such as steel may be employed for the chill strip 36 and its primary purpose is to add additional support to the panel adjacent to the point of welding to facilitate the welding operation and to maintain the panels in their undeformed condition. Strip 36 can be positioned in any conventional manner such as by a heat sinking process.

It should be kept in mind that the dimensions of the various layers of the panels can be varied depending upon the particular utilization of the panels on location. Naturally, modifications in design are contemplated. For example, the curb can alternately be connected to the panels in any conventional manner other than by welding. If welding is employed to connect curb 33 to the panels, the horizontal bead 34 may or may not be included depending upon individual preference. It should also be kept in mind that the ceiling panel, the corner joint 35, and the curb would have appropriate flaps to adjoin with the wall panels and facilitate welding of all of the component parts of the system. It is also readily apparent how the wall structure of the present invention is adaptable for exterior surfaces and in other environments which employ the use of paneling.

Thus, the above discussed objectives of the present invention, among others, are effectively attained.

We claim:

1. An impervious wall structure formed of a plurality of panels for use in covering an enlarged area such as the interior wall surface of a room and to form a vapor and insulation barrier without undue distortion across the entire surface, the surface having a smooth face to alleviate the accumulation of contamination material thereto and to facilitate cleaning of the surface; said plurality of panels each being of thin cross section, each panel having a smooth impervious exposed metal surface layer, and being positioned in side by side relation with an adjacent panel forming a joint between panels;

each panel further comprising a layer of substantially solid insulating material bonded to the said surface layer, and a backing layer, affixed to the insulating layer distal from the surface layer;

the layers of each panel forming a male and female vertical side edge;

seating means comprising the female vertical side edge by having the surface and backing layers extending beyond the layer of insulating material thereby forming a panel receptacle for receiving the male vertical side edge;

the male side edge having the backing, insulating and surface layers in substantial vertical alignment, the male side edge being inserted into the receptacle of the female side edge bringing the surface and backing layers of adjacent panels in overlapping relationship, and the overlapping layer of metal surfacing material welded to the surface layer of the adjacent panel.

2. The invention in accordance with claim 1 wherein each panel contains a vertical bead extending adjacent to each vertical edge of the surface layer forming a stress relief during welding thereby alleviating of distortion of the panel.

3. The invention in accordance with claim 1 wherein a chill strip is inserted into the layer of insulation material adjacent to the edge of each panel and adjacent to the area of welding of the panel to facilitate provision of a proper welding area for interconnection of the panels.

4. A method of forming an impervious wall structure of a plurality of panels of thin cross section for use in covering an enlarged area and to form a vapor and insulation barrier without undue distortion across the entire surface and the surface being smooth to alleviate the danger of accumulation of contaminating material thereon and to facilitate cleaning of the surface comprising:

providing a smooth metal surface layer;

bonding a layer of substantially solid insulating material to the rear side of the metal surface layer;

affixing a backing layer to the side of the insulating material distal from the metal surface layer;

forming a female vertical side edge on said panel by providing the backing and surface layers extending beyond the insulating layer thereby forming a receptacle;

forming a male vertical side edge on said panel by locating the surface, insulating and backing layers on said edge in substantial vertical alignment;

placing said male edge in the receptacle thereby overlapping the backing and surface layers of adjacent panels thus positioning said panels in side by side relationship;

and continuously welding the overlapping surface layers of adjacent panels together forming a seam weld.

5. The invention in accordance with claim 4 wherein prior to bonding of the insulating material to the panels, a vertical bead is formed in each panel extending adjacent to the vertical edge of the panel to assist in stress relief of the panel during welding and thereafter alleviating the danger of distortion of the panel.

6. The invention in accordance with claim 4 including the step of inserting a chill strip into the layer of insulation material adjacent to the edge of each panel and adjacent to the area of welding of the panel to facilitate provision of a proper welding area for interconnection of the panels.

* * * * *